United States Patent [19]

Bonneyrat et al.

[11] Patent Number: 4,930,991

[45] Date of Patent: Jun. 5, 1990

[54] PISTON PUMP FOR HIGH PERFORMANCE LIQUID CHROMATOGRAPHY

[75] Inventors: Alain Bonneyrat, Saint-Martin du Tertre; Christian Langlais, Domont, both of France

[73] Assignee: Gilson Medical Electronics (France), Villiers le Bel, France

[21] Appl. No.: 304,066

[22] Filed: Jan. 30, 1989

[30] Foreign Application Priority Data

Feb. 10, 1988 [FR] France ..... 88 01591

[51] Int. Cl.[5] ..... F04B 49/00

[52] U.S. Cl. ..... 417/18; 417/45; 417/63; 417/415

[58] Field of Search ..... 417/18, 63, 12, 15, 417/22, 45, 415

[56] References Cited

U.S. PATENT DOCUMENTS

| | | | |
|---|---|---|---|
| Re. 31,586 | 5/1984 | Magnussen, Jr. | 417/22 |
| 4,131,393 | 12/1978 | Magnussen | 417/22 |
| 4,326,837 | 5/1982 | Gilson et al. | 417/63 |
| 4,681,513 | 7/1987 | Saito et al. | 417/18 |

FOREIGN PATENT DOCUMENTS 0223643 5/1987 European Pat. Off. .

*Primary Examiner*—Leonard E. Smith
*Assistant Examiner*—D. Scheyermann
*Attorney, Agent, or Firm*—Mason, Kolehmainen, Rathburn & Wyss

[57] ABSTRACT

A pump comprising at least a pump body having a chamber (110) communication with an inlet duct (130) and an outlet duct (140) via respective inlet and outlet valves (136, 146), a piston (120) moveable in sealed manner within said chamber, a cyclical actuator (400) of the rotary cam type for co-operating with said piston to cause it to slide, and a motor (500) for driving the cam in an unchanging predetermined direction while injecting volumes greater than the cylinder capacity of the pump, wherein the pump includes control means (404, 220, 600) adapted, on detecting that a required volume has been injected, to determine the position occupied by the rotary cam and to return the piston to the initial position of its delivery stroke prior to injecting a following volume by reversing the direction of rotation of the motor during reinitialization of the piston whenever the rotary cam is positioned on its delivery slope on such detection, and in contrast reinitializing the piston without reversing the direction of rotation whenever the rotary cam is positioned on its suction slope on such detection.

6 Claims, 3 Drawing Sheets

PISTON PUMP FOR HIGH PERFORMANCE LIQUID CHROMATOGRAPHY

The present invention relates to precision piston pumps.

The present invention is particularly applicable to high performance liquid phase chromatography (HPLC). In this application, the pumps for injecting a sample and/or one of the selected solvent(s) into the packing of a chromotographic installation must be free from any fluctuations in pressure and/or flow rate and/or volume.

BACKGROUND OF THE INVENTION

Numerous pumps have already been proposed comprising at least a pump body having a chamber which communicates with an inlet duct and an outlet duct via respective inlet and outlet valves, a piston moveable in sealed manner within said chamber, a cyclical actuator such as a rotary for cam co-operating with said piston to cause it to slide, and a motor for driving the cam in an unchangeing predetermined direction while injecting volumes greater than the cylinder capacity of the pump (see for example U.S. Pat. No. 4,326,837.

Pumps of the above-specified type have already provided good service.

However, these pumps do not provide complete satisfaction, more precisely they do not provide satisfactory reproducibility when the unit volumes of sample and/or solvent to be injected are of the same order of magnitude as the cylinder capacity of the pump.

In other words, although unavoidable fluctuations in the injected volume, e.g. due to the inlet and outlet valves and/or to the compressibility of the liquids concerned, can be integrated out when the total injected volume corresponds to a large number of pump cycles, said volume fluctuations are no longer integrated out when the total injected volume is of the same order of magnitude as the cylinder capacity of the pump, e.g. when it corresponds merely to a fraction of one pump cycle.

SUMMARY OF THE INVENTION

The present invention seeks to overcome these drawbacks by proposing a novel pump of the above-specified type and comprising at least a pump body having a chamber communicating with an inlet duct and an outlet duct via respective inlet and outlet valves, a piston moveable in sealed manner within said chamber, a cyclical actuator of the rotary cam type for cooperating with said piston to cause it to slide, and a motor for driving the cam in an unchangeing predetermined direction while injecting volumes greater than the cylinder capacity of the pump, wherein the pump includes control means adapted, on detecting that a required volume has been injected, to determine the position occupied by the rotary cam and to return the piston to the initial position of its delivery stroke prior to injecting a following volume by reversing the direction of rotation of the motor during reinitialization of the piston whenever the rotary cam is positioned on its delivery slope on such detection, and in contrast reinitializing the piston without reversing the direction of rotation whenever the rotary cam is positioned on its suction slope on such detection.

The present invention makes it possible to ensure that a required volume of sample and/or solvent is always injected from a predetermined starting position of the piston. The effects of possible fluctuations in volume due to the inlet and outlet valves and/or to the compressibility of the liquids are then no longer random, but are, on the contrary, reproducible and therefore easily taken into account and/or controlled.

Advantageously, the drive motor is a stepper motor and the delivery stroke of the piston includes an initial precompression stage, with the number of motor steps required for the precompression stage being determined by the control means on the basis of the following equation:

$$N=(NK).(E).(P).(Vo)/S$$

in which:

NK is the number of motor steps required for moving the piston one centimeter;

E is a compressibility parameter for the liquid being injected given in pascal $-1$;

P is the required pressure given in pascal;

Vo is the volume of the chamber in the pump body in $cm^3$; and

S is the area of the piston in $cm^2$.

BRIEF DESCRIPTION OF THE DRAWINGS

An implementation of the present invention is described by way of example with reference to the accompanying drawings, in which.

MORE DETAILED DESCRIPTION

Figures 1, 1A:
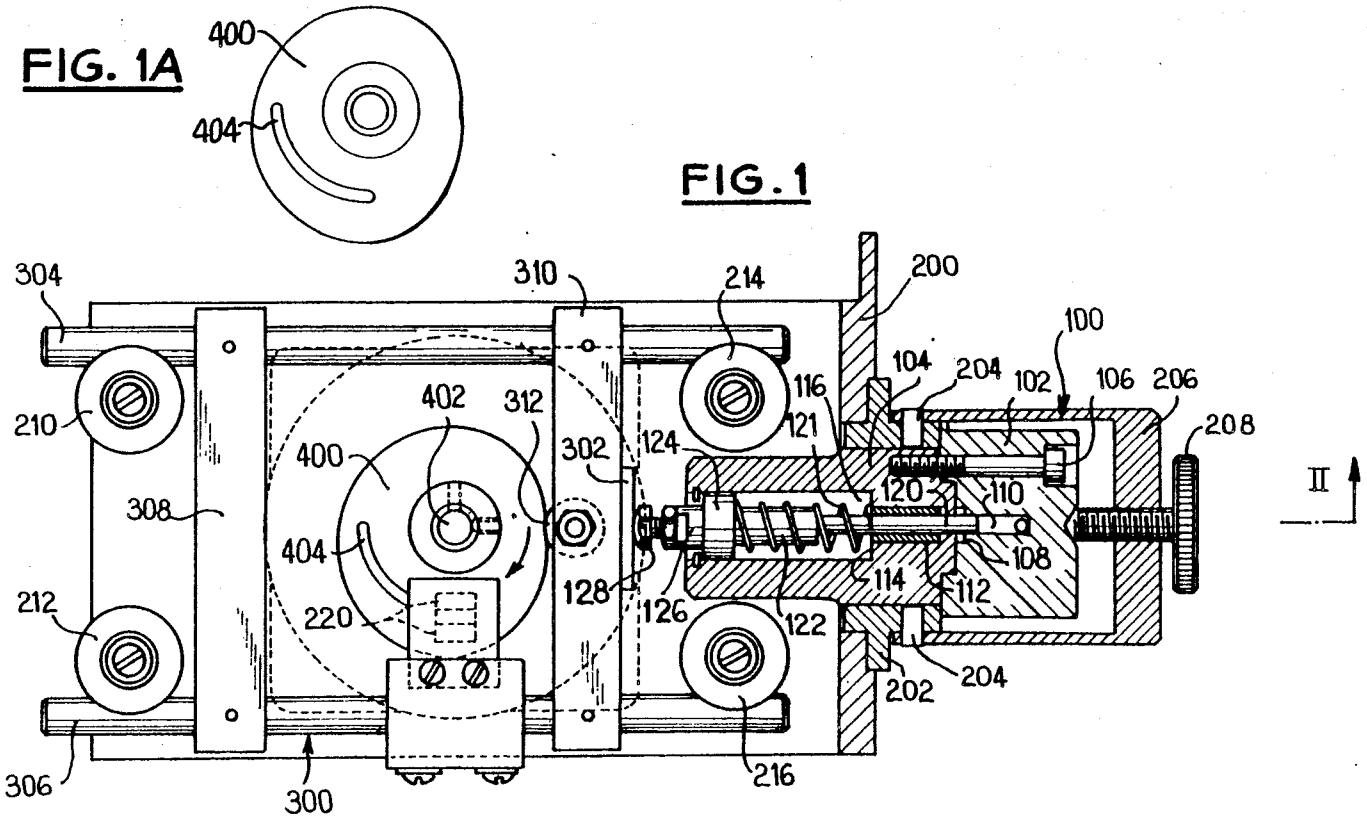
FIG. 1 is a horizontal section view through a pump in accordance with the present invention.
FIG. 1A is a view of the rotary cam in accordance with the present invention.

The general structure of the pump shown in the accompanying drawings is identical to the general structure of the pump described and shown in published French patent application number FR-2 461 126 in the name of Gilson Medical Electronics (France) and it corresponds to the pumps currently sold by said company over many years under the references pump 302 and pump 303. That is why the general structure of the pump is not described in greater detail below.

The main features of the pump shown in the accompanying figures are a pump body 100, a frame 200, a carriage 300, a cam 400, a motor 500, and control means 600.

The pump body comprises two portions 102 and 104 which are fixed to each other, e.g. by means of bolts such as 106. A sealing gasket 108 is disposed between the two portions 102 and 104. The portions 102 and 104 are provided with coaxial cylindrical bores which are in communication with each other.

The bore 110 in the portion 102 is a blind hole. It defines the pumping chamber.

The adjacent bore provided in the portion 104 receives cylindrical packing 112. A piston 120 is slidably mounted through the above-mentioned bores provided in the portions 102 and 104. The piston 120 is guided by the packing 112. The leading end of the piston 120 is displaced back and forth in the pumping chamber 110 by means described below.

An inlet duct 130 is fixed by a hermetic gland 132 to an inlet connection 134. This is provided with a valve 136. The outlet from the valve 136 communicates with the pumping cavity 110.

Symmetrically, on the outlet side, the pumping cavity 110 communicates via a valve 146 integrated in a connection 144 with an outlet duct 140. This duct is fixed on the connection 144 by a high pressure gland 142.

As recalled in the above-mentioned U.S. Pat. No. 4,326,837, it is important to obtain a very high degree of sealing both at the gasket 108 and at the valves 136 and 146. To this end, it is preferable for the gasket 108 to be an O-ring having a U-shaped cross-section enclosing an annular spring. In addition, the valves 136 and 146 are advantageously valves having ruby beads on sapphire seats.

At its end furthest from the pumping chamber 110, the piston 120 is provided with a piston head 122 followed by a larger diameter shoulder 124 and then an end portion 126 of substantially the same diameter as the piston head 122. The end portion 126 carries an adjustable abutment 128. A spring 121 is interposed between the shoulder 124 and the bottom 114 of the bore 116 receiving the piston head 122, behind the packing 112. The spring 121 constantly urges the piston 120 towards the left in FIGS. 1 and 2, i.e. towards a suction position, that is to say a position for filling the pumping chamber 110. The adjustable abutment 128 may be constituted, for example, by a screw having a lock nut. The adjustable abutment 128 bears against a plate 302 carried by the carriage 300.

The frame 200 includes a circular flange 202 provided with pivots 204. These pivots support a bracket 206 fitted with a knurled knob 208. The pump body 100 constituted by the abovementioned portions 102 and 104 is adapted to be engaged inside the flange 202. It is fixed therein by means of the knurled knob 208 bearing against the portion 102 of the pump body as shown in the accompanying drawings.

The frame 200 supports two pairs of wheels 210, 212, 214, 216 whose axes define the corners of a rectangle whose long sides are parallel to the axis Of the piston 120.

The carriage 300 includes two parallel cylindrical rods 304 and 306. The rods 304 and 306 run parallel to the axis of the piston 120. They are guided by the outsides of said wheels Two bars 308 and 310 are fixed transversely across the rods S04 and S06, thereby completing the carriage. The plate 302 serving as the adjustable abutment 128 is carried by the bar 310. In addition, said bar 310 carries the wheel 312 which co-operates with the cam 400. The wheel 312 is free to rotate relative to the bar 310 about a vertical axis which is parallel to the axes of the wheels 210, 212, 214, 216 and transverse to the axis of the piston 120.

The cam 400 is guided in rotation relative to the frame 200 about an axis which is parallel to the axis of the wheel 312.

The cam 400 is mounted on a shaft 402. The cam 400 carries a flag 404 whose structure is described in greater detail below. The flag 404 is adapted to pass between the two tines of an optical detector fork 220 carried by the frame 200. The fork 200 comprises firstly an optical beam emitter (preferably for infrared light) and secondly an associated facing receiver. Reception of the optical beam by the receiver is interrupted when the flag 404 lies between the two tines of the fork. The fork 220 consequently serves to detect the position of the drive cam 400.

The detector fork 220, and more precisely the receiver integrated therein, is connected to the control means 600 by a link 602.

The shaft 402 carrying the cam 400 is driven by the motor 500. This motor is preferably a stepper motor such as the SLOSYN (registered trademark) MO 91-FD-06 motor manufactured by the American firm Superior Electric. The means for controlling the stepper motor 500 integrated in the control means 600 are preferably adapted to provide fine displacement of the motor 500. These control means may comply with the dispositions described and shown in French patent application FR-A-2 440 642 in the name of Gilson Medical Electronics (France).

In normal operation, the motor 500 and its associated cam 400 are always driven in the same direction which is clockwise in FIG. 1.

The person skilled in the art will readily understand that since the external periphery of the cam 400 is not circularly symmetrical about the axis of the shaft 402, when the cam 400 is rotated by the motor 500, it imparts back and forth displacement to the carriage 300 thus imparting back and forth reciprocating displacement to the piston 120 in the pump chamber 110.

Preferably, the cam 400 has a bottom dead center point (a point radially closest to the axis of the shaft 402) and a top dead center point (the point furthest from the axis of the shaft 402), with the external periphery of the cam diverging progressively between the bottom dead center point and the top dead center point about the axis of the shaft 402.

Figure 2:
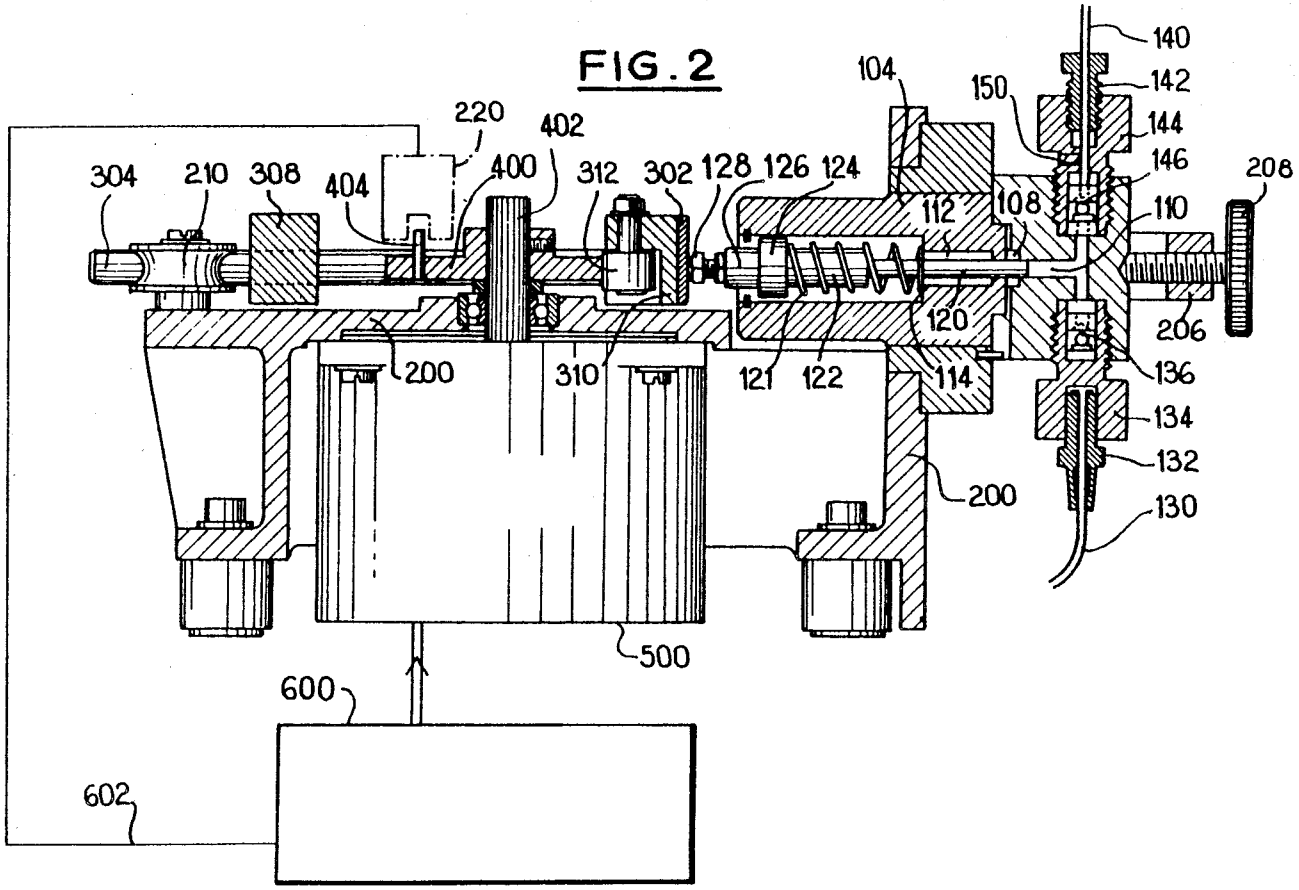
FIG. 2 is a diagrammatic vertical section through the same pump on a section plane referenced II in FIG. 1.

When the cam 400 is displaced from the top dead center point towards the bottom dead center point (with reference to its point of contact with the wheel 312), the carriage 300 and the piston 120 are moved to the left in FIGS. 1 and 2. The piston 120 is thus moved out from the pumping chamber 110. This displacement corresponds to a suction phase during which the pumping chamber 110 is filled via the inlet valve 136.

Conversely, while the cam 400 is being displaced from its bottom dead center point towards its top dead center point, the carriage 300 and the piston 120 are moved to the right in FIGS. 1 and 2. The piston is thus moved into the pumping chamber 110 and tends to empty it. The fluid previously sucked into the pumping chamber 110 is then delivered via the outlet valve 146.

Preferably, the top and bottom dead center points on the cam 400 are 90° apart about the axis of the cam 402. More precisely, the external profile of the cam 400 going from its top dead center point to its bottom dead center point and corresponding to the suction phase, i.e. the stage during which the pump chamber 110 is filled, extends over an angle of about 90°. In contrast, the external profile of the cam 400 going from its bottom dead center point to its top dead center point and corresponding to the stage during which liquid is delivered from the pumping chamber 110 extends over an angle of about 270°. The above-mentioned flag 404 is advantageously constituted by an annular sector centered on the axis 402 and occupying the same angular extent as one or other of the two above-specified profiles, i.e. either 90° in order to coincide with the suction profile going from top dead center to bottom dead center, or else 270° in order to coincide with the delivery profile going from bottom dead center to top dead center.

The flag 404 is fixed to the cam 400. However, it is angularly offset relative to the associated suction profile through an angle identical to the angular offset between the detecting fork 220 and the contact point between the wheel 312 and the cam 400.

In the preferred embodiment shown in the accompanying figures, the flag 404 occupies an angular extent of 90° corresponding to the angular extent of the suction profile of the cam 400 going from its top dead center point to its bottom dead center point. The flag 404 is offset through 90° relative to the suction profile of the cam 400 going from its top dead center point to its bottom dead center point since the detection fork 220 is offset by 90° relative to the point of contact between the wheel 312 and the cam 400, with the angles being measured about the axis of the shaft 402.

As mentioned above, the control means 600 in accordance with the invention are designed to return the piston 120 to a predetermined initialization position after injecting a required volume and prior to injecting a following volume.

The predetermined initialization position of the piston corresponds to the initial position of a delivery stroke, i.e. to the bottom dead center point of the cam 400, as shown in the accompanying figures.

However, in order to avoid any accidental injection through the outlet valve 146 during piston initialization, the control means 600 are adapted, in co-operation with the fork 220, to determine the position occupied by the rotary cam 400 on detecting that a required volume has been injected In this case, the control means 600 control the direction of rotation of the motor 500 driving the cam 400 in such a manner that whenever the piston 120 is moved towards its initialization position, the rotary cam 400 is always driven towards its bottom dead center point.

More precisely, if the cam 400 is positioned on its delivery profile (i.e. the wheel 312 is resting against the profile of the cam lying between its bottom dead center point and its top dead center point) when it is detected that a required volume has been injected, then the direction of rotation of the motor 500 is reversed while returning the piston 120 to its initialization position.

Conversely, if the cam 400 is positioned on its suction profile (i.e. if the wheel 320 engages the profile of the cam 400 between its top dead center point and its bottom dead center point) when it is detected that a required volume has been injected, then the direction of rotation of the motor remains identical to its normal direction of rotation as shown in FIG. 1 while moving the piston 120 towards its initialization position.

In the particular embodiment of the flag 404 described above and shown in the accompanying figures, whereby the flag 404 is constituted by an annular sector having the same angular extent as the cam suction profile, i.e. the profile of the cam 400 running from its top dead center point to its bottom dead center point, the motor 500 is controlled as follows when reinitializing the piston 120.

If the flag 404 does not lie between the tines of the fork 220 when it is detected that a required volume has been injected, then the direction of rotation of the motor 500 is reversed relative to its normal direction until its bottom dead center point is reached.

Conversely, if the flag 404 is located between the tines of the fork 220 when it is detected that a required volume has been injected, then the direction of rotation of the motor 500 is maintained identical to its normal direction of rotation in order to reinitialize the motor 120.

Figure 3:
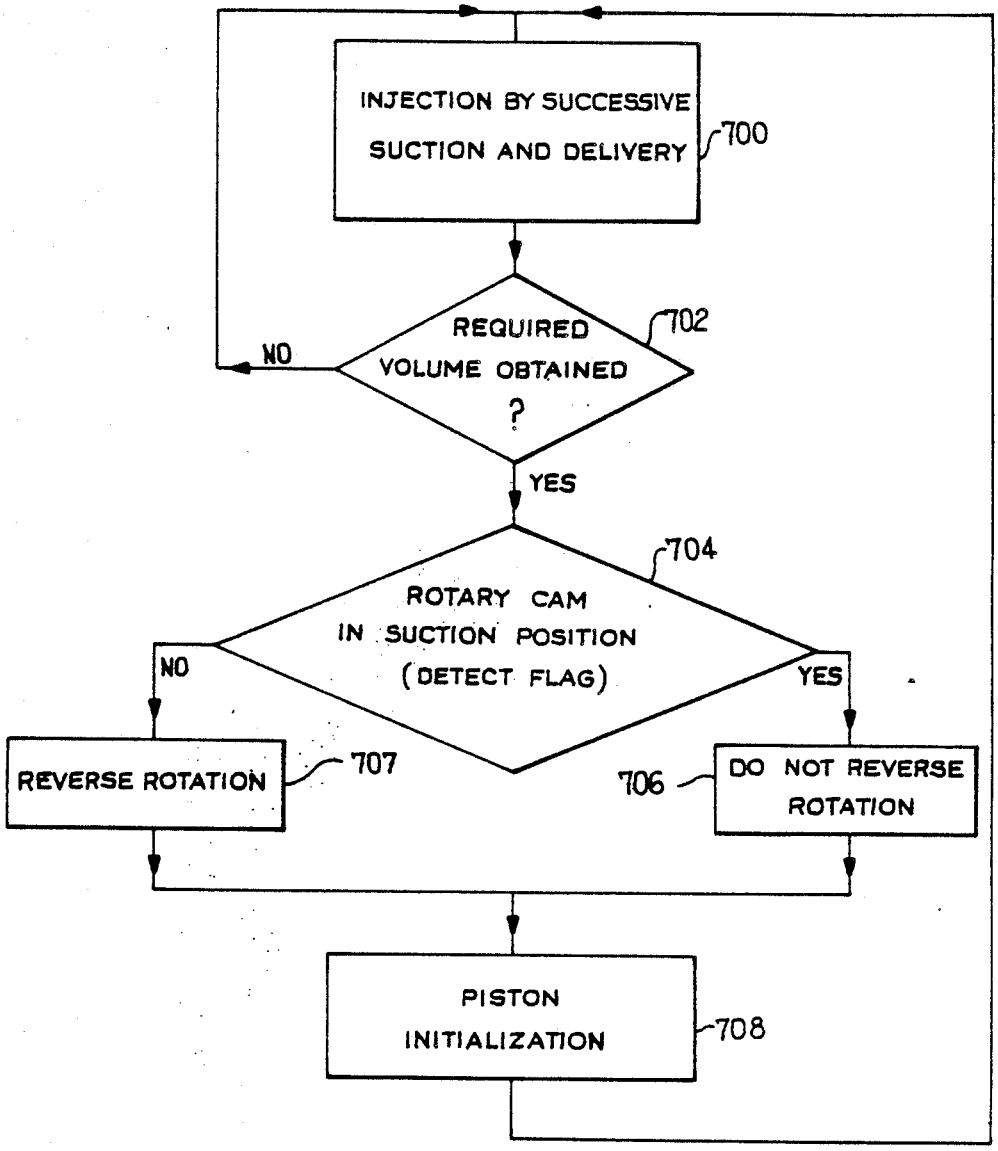
FIG. 3 is a flow chart showing the operation of a pump in accordance with the invention.

This process is illustrated in FIG. 3. So long as stage 702 has not detected that a required volume has been obtained, a sample and/or a solvent is injected by successive suction and delivery strokes at stage 700. When stage 702 detects that the required volume has been obtained, the means 600 examine the position of the rotary cam in stage 704. If the cam is positioned on its suction slope, i.e. if the flag 404 is detected by the fork 220, then the piston 120 is reinitialized via stages 706 and 708 without reversing the direction of rotation of the motor. In contrast, if the rotary cam is not detected during stage 704 as being on its suction slope, i.e. if the flag 404 is not detected as being between two tines of the fork 220, then the piston 120 is reinitialized during stages 707 and 708 by reversing the direction of rotation of the motor 500.

It may be observed that the top and bottom dead center points of the cam 400 coincide with the ends of the flag 404 being detected by the fork 220.

Preferably, and in conventional manner, the delivery stroke (displacement of the cam 400 from its bottom dead center point towards its top dead center point) includes an initial, high speed precompression stage for the liquid contained in the pumping chamber 110 in order to reach the pressure required by the chromatograph column rapidly at the outlet of the valve 146.

In the context of the present invention, the number N of steps required to obtain the precompression stroke of the piston 120 is determined on the basis of the equation:

$$N=(NK).(E).(P).(Vo)/S$$

in which:

NK is the number of motor steps required for moving the piston one centimeter;

E is a compressibility parameter for the liquid being injected given in pascal 1;

P is the required pressure given in pascal;

Vo is the volume of the chamber in the pump body in $cm^3$; and

S is the area of the piston in $cm^2$.

This disposition makes it possible to obtain the required pressure in optimum manner regardless of the liquid that is to be injected.

The injection pressure may be monitored by means of a pressure transducer placed downstream from the outlet valve 146 and integrated, for example, in the outlet connection 144 as illustrated by reference 150 in FIG. 2.

The value of the compressibility parameter E specific to the liquid injected may be given to the control means 600 via a keyboard, via an encoding wheel, or via other, equivalent means.

Naturally the present invention is not limited to the particular embodiment described but covers any variant falling within the scope of the claims. The particular structure of the pump body described above and shown in the accompanying figures can be varied in numerous ways.

We claim:

1. A pump comprising at least a pump body having a chamber communicating with an inlet duct and an outlet duct via respective inlet and outlet valves, a piston movable in sealed manner within said chamber, so as to inject a volume of liquid which is equal to the cylinder capacity of the pump, each time the piston performs one backward and forward motion, a cyclical actuator of the rotary cam type for cooperating with said piston to cause the slide, and a motor for driving the cam in an unchanging predetermined direction during injection operation, wherein the pump includes control means adapted, on detecting that a required volume has been injected, to determine the position occupied by the rotary cam and to return the piston to the initial position of its delivery stroke prior to injecting a following volume by reversing the direction of rotation of the motor during reinitialization of the piston whenever the rotary cam is positioned on its delivery slope on such detection and in contrast reinitializing the piston without reversing the direction of rotation whenever the rotary cam is positioned on its suction slope on such detection.

2. A pump according to claim 1, wherein the control means include a flag fixed to the rotary cam and in the form of an annular sector centered on the cam and extending over an annular extent which is identical to the annular extent of the suction slope of the cam, said flag being associated with an optical detection fork.

3. A pump according to claim 1, wherein the control means include a flag fixed to the rotary cam and constituted by an annular sector centered on the cam, said sector having an annular extent which is identical to the annular extent of the delivery slope of the cam and being associated with an optical detection fork.

4. A pump according to claim 2, in which the flag is in the form of an annular sector occupying an angular extent of about 90°.

5. A pump according to claim 1, in which the motor is a stepper motor.

6. A pump according to claim 1 in which the drive motor is a stepper motor and in which the delivery stroke of the piston includes an initial precompression stage with the number of motor steps required for the precompression stage being determined by the control means on the basis of the following equation:

$$N=(NK)\ (E)\ (P)\ (V_0)/S[N=(NK.E.P.V_0)/S]$$

in which:

NK is the number of motor steps required for moving the piston 1 centimeter;

E is a compressibility parameter for the liquid being injected, given in Pascal−1;

P is the required pressure, given in Pascal;

$V_0$ is the volume of the chamber in the pump body in $cm^3$; and S is the area of the piston in $cm^2$.

* * * * *